US005675133A

United States Patent [19]

Kobayashi

[11] Patent Number: 5,675,133

[45] Date of Patent: Oct. 7, 1997

[54] HORN AND SOUNDER

[76] Inventor: Yu Kobayashi, 17-15, 1Chome, Nigawatakamaru, Takarazuka City, Hyogo Pref, Japan

[21] Appl. No.: 625,226

[22] Filed: Apr. 1, 1996

[51] Int. Cl.[6] ..... G10K 11/00

[52] U.S. Cl. ..... 181/189; 181/190; 181/188

[58] Field of Search ..... 181/178, 182, 181/185, 186, 187, 188, 189, 190, 192, 195; D14/208

[56] References Cited

U.S. PATENT DOCUMENTS 4,703,829 11/1987 Hardt ..... 181/178

5,094,317 3/1992 Ladendorf ..... 181/178

5,160,815 11/1992 Prater ..... 181/182

*Primary Examiner*—Khanh Dang

*Attorney, Agent, or Firm*—Bacon & Thomas

[57] ABSTRACT

The horn and sounder includes an upper body, a lower body, and a mouth piece. The upper and lower bodies are provided at their rear outer periphery with annular ribs to engage with grooves formed inside the mouth piece, so that the mouth piece can bind the upper and the lower bodies together. The upper and the lower bodies are provided on their inner plane near a rear central portion with a protuberance, making the two bodies slightly separated from each other at their front potions. The present invention can be used to produce loud sound simply by patting it.

1 Claim, 5 Drawing Sheets

HORN AND SOUNDER

BACKGROUND OF THE INVENTION

1. Field of the Invention

The present invention relates to an improved Horn and Sounder including an upper body, a lower body, and a mouth piece. The upper and the lower bodies are provided at their rear outer periphery with annular ribs to engage with grooves formed inside the mouth piece, so that the mouth piece can bind the upper and the lower bodies together. Moreover, the upper and the lower bodies are provided on their inner plane near a rear central portion with a protuberance, making the two bodies to slightly separate from each other.

2. Description of the Prior Art

FIG. 1 illustrates a perspective of a conventional horn for cheering during sport games. Such conventional horn usually consists of two serially connected plastic conic members both having smooth surface. Such horn can not be easily firmly gripped and has only one function, that is, to provide louder sound but only within a limited range. To encourage those outstanding athletes, the audiences can only clap their hands and/or cheer loudly which are; of course, not so effective in bringing the whole game into a completely exciting air. Some people shall use two of such horns to strike one with the other so as to produce big sound. However, the sound so produced is low and heavy in tune and therefore has bad effect in creating the high air. In addition, more horns means higher cost and increased space required by them. It is also inconvenient to handle and take care so many horns at the same time. Therefore, it is desirable to develop a horn which has improved function to easily provide an air of wild excitement in the game.

SUMMARY OF THE INVENTION

A primary object of the present invention is to provide a means which can be used not only as a horn to transmit voice to an even wider range but also as a means to produce loud cheering sound simply by patting it.

Another object of the present invention is to provide an improved horn and sounder which has simple structure and is easy to assemble, hold and carry with.

The horn and sounder according to the present invention mainly includes an upper body, a lower body, and a mouth piece. The upper and the lower bodies are provided at their rear outer periphery with annular ribs to engage with grooves formed inside the mouth piece, so that the mouth piece can bind the upper and the lower bodies together. Moreover, the upper and the lower bodies are provided on their inner plane near a rear central portion with a protuberance, making the two bodies to slightly separate from each other at their front portions. Thereby, the present invention can be used to produce loud sound simply by patting it.

BRIEF DESCRIPTION OF THE DRAWINGS

The features and functions of and the technical means adopted by the present invention can be best understood by referring to the following detailed description of the preferred embodiment and the accompanying drawings, wherein.

DETAILED DESCRIPTION OF THE PREFERRED EMBODIMENT

Figure 1:
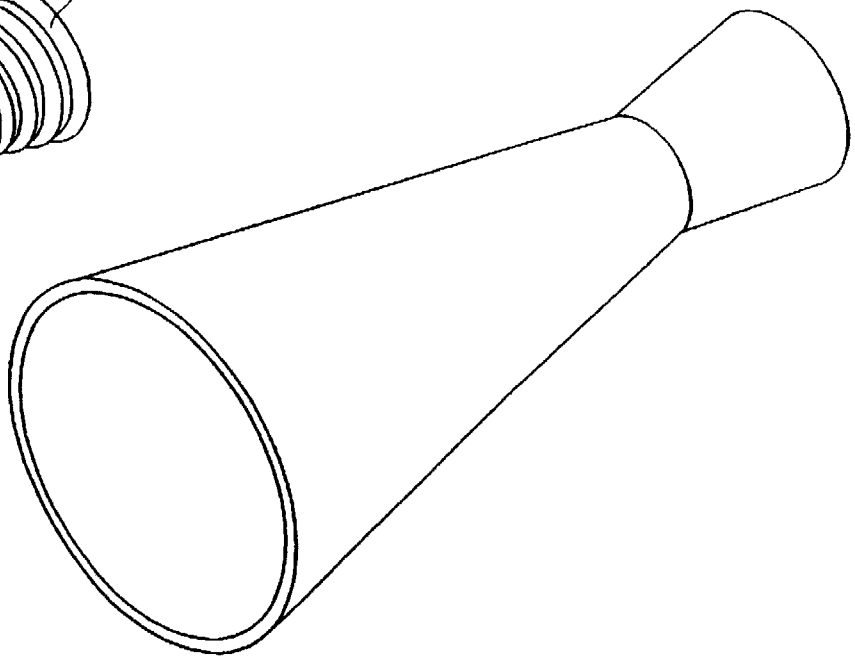
FIG. 1 PRIOR ART
FIG. 1 is a perspective of a conventional horn for cheering sections.
Figure 2:
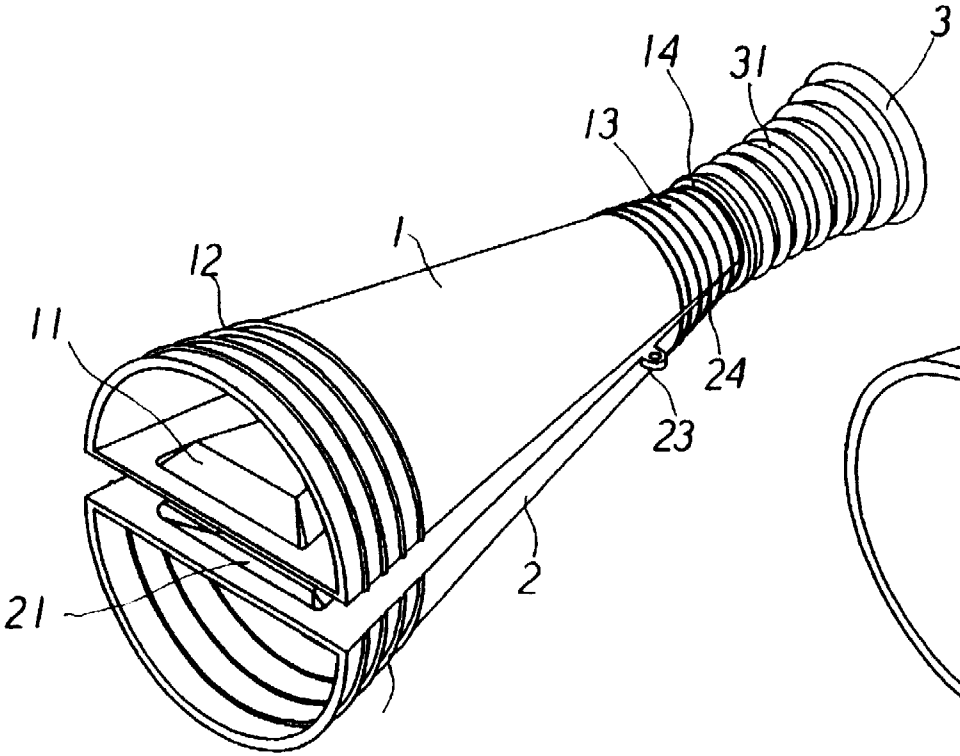
FIG. 2 is an assembled perspective of the present invention.
Figure 3:
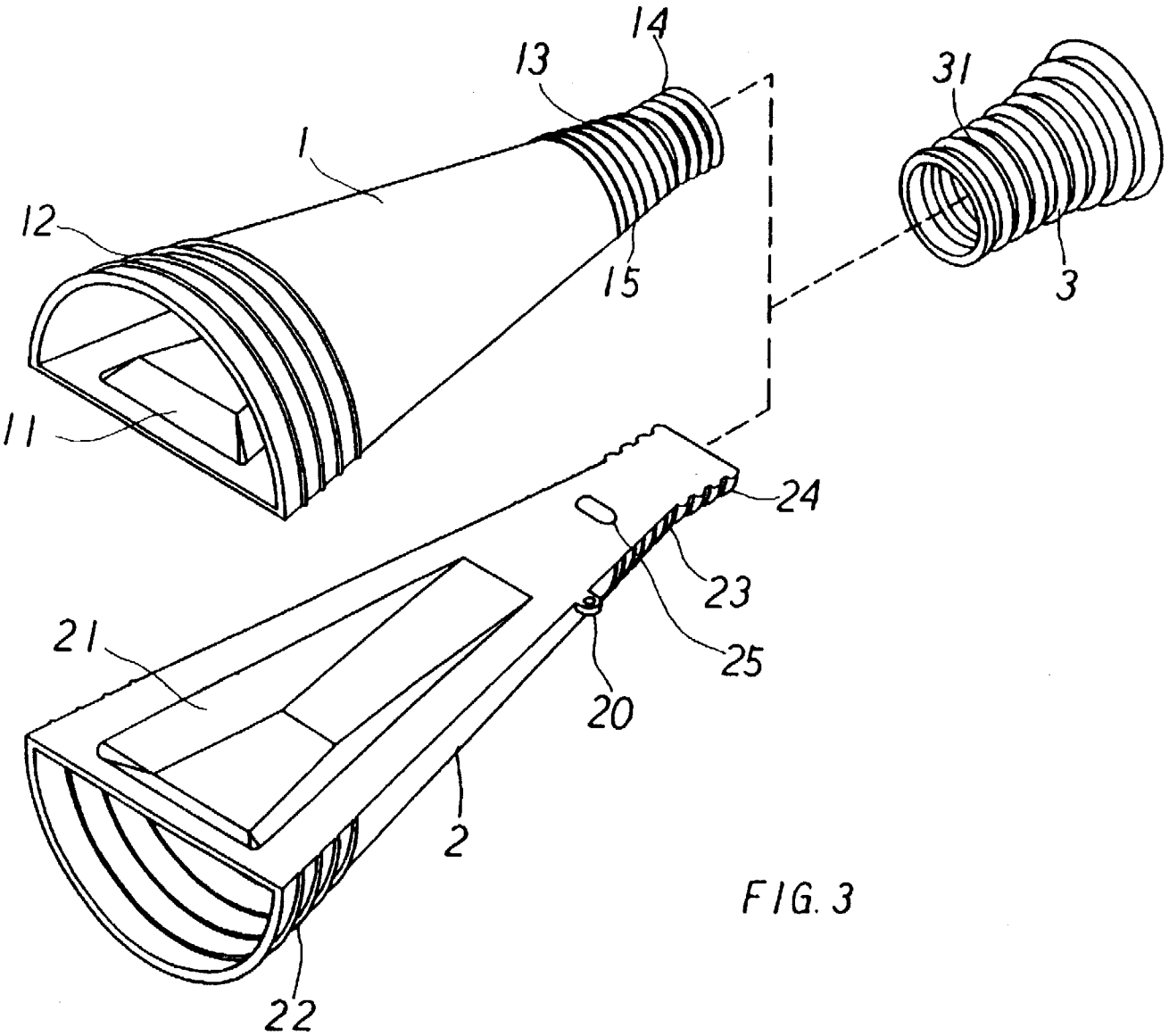
FIG. 3 is an exploded perspective of the present invention.

Please refer to FIGS. 2 and 3. The present invention is a horn and sounder mainly includes an upper body 1, a lower body 2, and a mouth piece 3. The upper and the lower bodies 1, 2 have a substantially semicircular cross section and form two symmetrical halves of a horn. Front anti-slip lines 12, 22 and rear anti-slip lines 13, 23 are parallelly and circumferentially formed on an outer periphery near a front and a rear ends of the two halves 1, 2, respectively, so that the present invention can be firmly held by a user. Recesses 11, 21 are separately formed on an inner plane of each half near a front portion thereof, together serving as a means to produce loud sound. For the present invention to be conveniently carried by the user, a hanger 20 is provided at one side of the lower body 2.

The upper and the lower bodies 1, 2 are also provided at their rear end with a plurality of annular ribs 14, 24, respectively, which raise from an outer peripheral surface of the rear ends of these two halves. And, there are also annular ribs 31 formed around an outer surface of the mouth piece 3, such that grooves are correspondingly formed on an inner wall of the mouth piece 3 to engage with the annular ribs 14, 24 on the two halves 1, 2, and thereby firmly binds the rear ends of the two halves 1, 2 together in the mouth piece 3, permitting the two halves 1, 2 to form one unit.

Figures 4A, 4B:
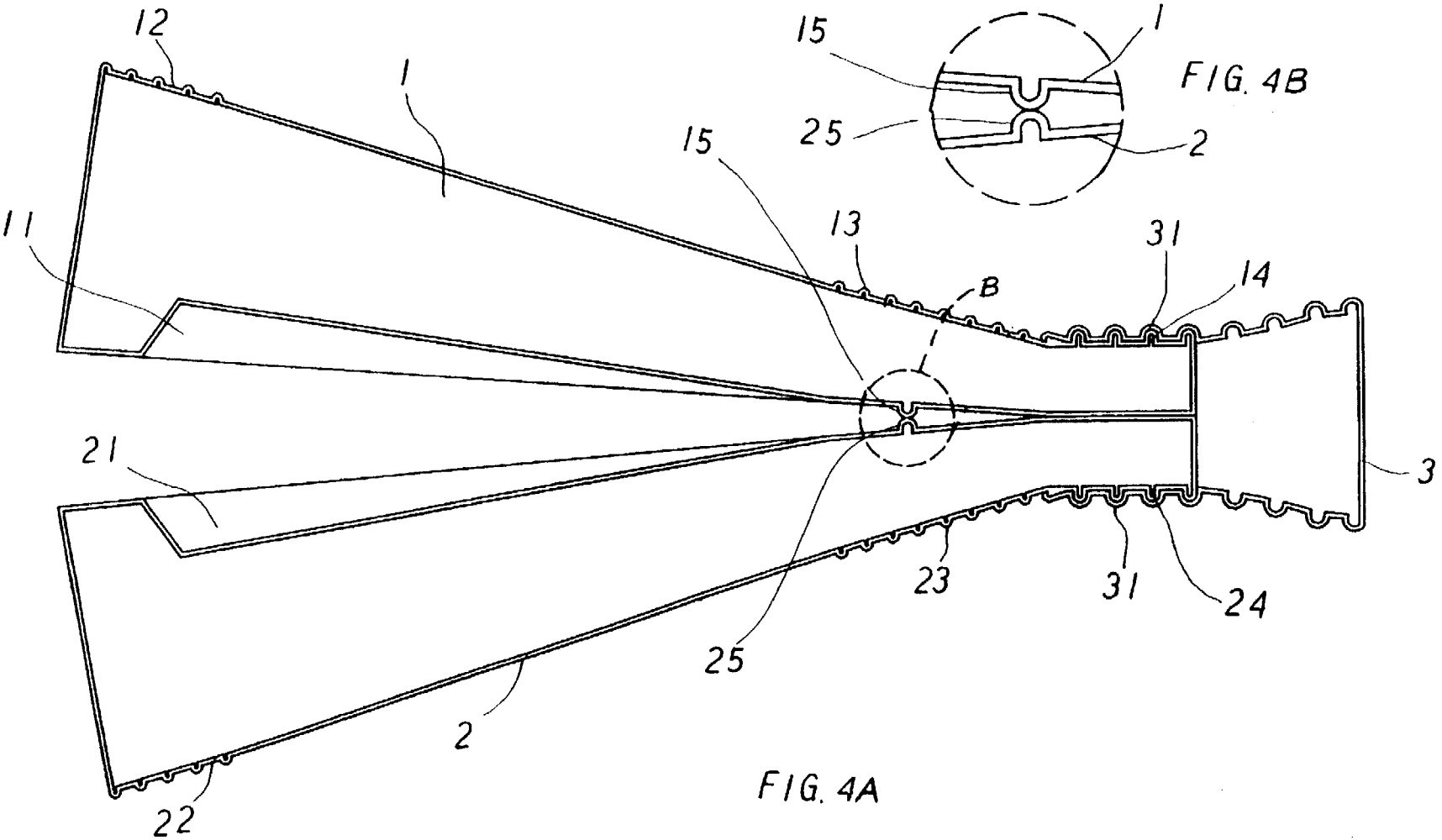
FIG. 4 is a sectional view showing the present invention in an assembled state.

There are two protuberances 15, 25 respectively provided on the inner planes of the two halves 1, 2 near a rear portion thereof. When the two halves 1, 2 are bound together by the mouth piece 3, the two protuberances 15, 25 press against each other, as shown in FIG. 4, causing the two halves 1, 2 to slightly separate from each other at their front portions. The open apart front portions of the two halves 1, 2 allow the user to lightly pat the present invention or to strike one horn with another to produce loud sound to create fervent emotion.

Please now refer to FIG. 4. To assemble the horn and sounder of the present invention, simply put the upper and the lower bodies 1, 2 together with their inner planes facing each other and the two protuberances 15, 25 pressing aginst each other, and then, put the mouth piece 3 over the rear ends of the two halves 1, 2 with the annular grooves inside the ribs 31 of the mouth piece 3 fitly engaging with the annular ribs 14, 24 on the two halves 1, 2. The upper and the lower bodies 1, 2 are therefore, firmly bound together in the mouth piece 3 with their front end slightly open apart.

Figure 5:
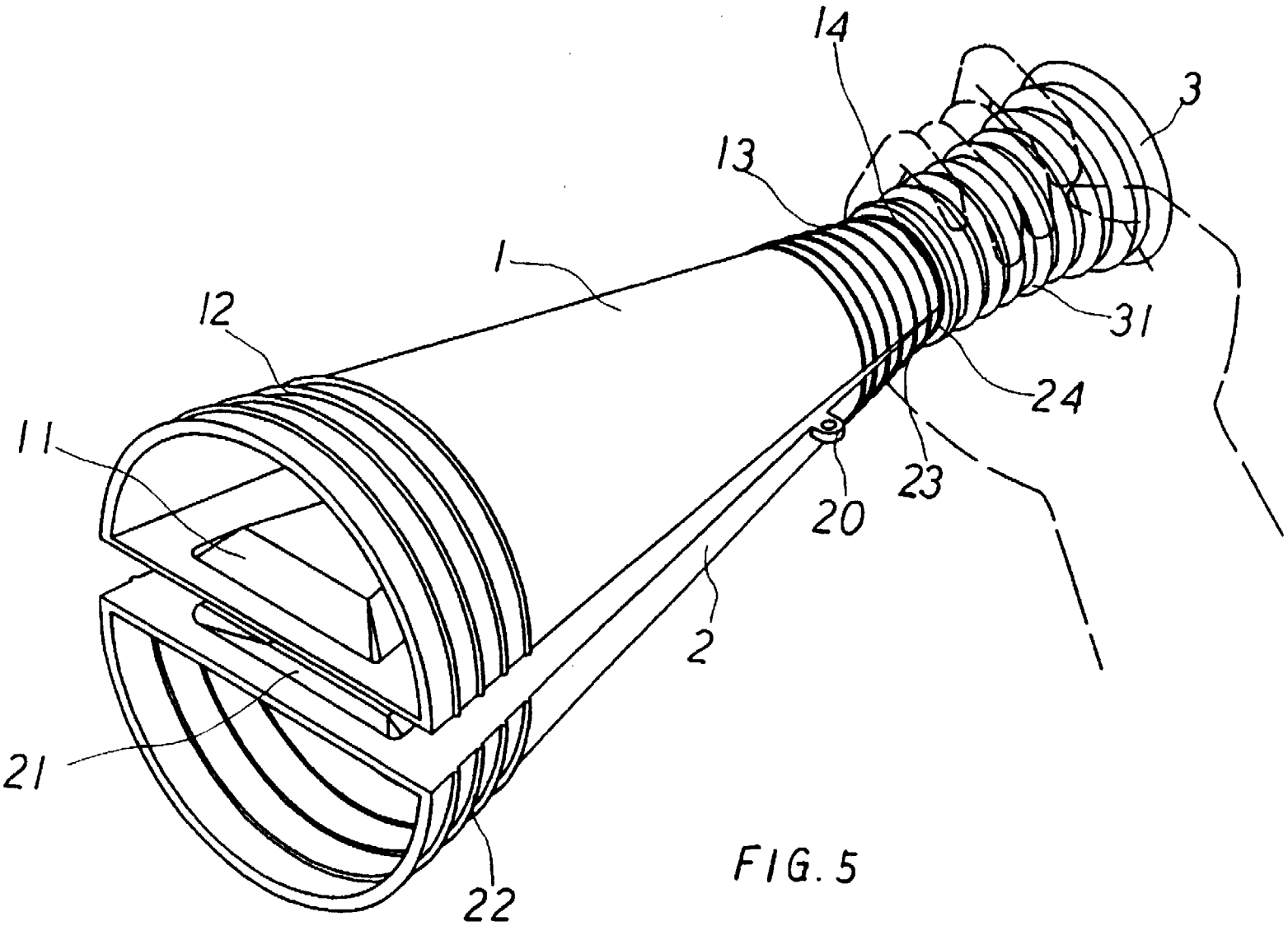
FIG. 5 illustrates the manner in which the present invention is held by a user for shouting and yelling.

Please refer to FIG. 5. To use the horn and sounder of the present invention, simply hold it by gripping with a hand at the mouth piece 3, and put the horn close to the user's mouth. When the user speaks or yells against the mouth piece 3, his or her voice shall immediately be transmitted from the two gradually expanded halves 1, 2 to a distant and wide range loudly. The annular ribs 31 enable the user to firmly and conveniently hold the present invention without the risk of disengagement of the two halves 1, 2 from the mouth piece 3.

Figure 6:
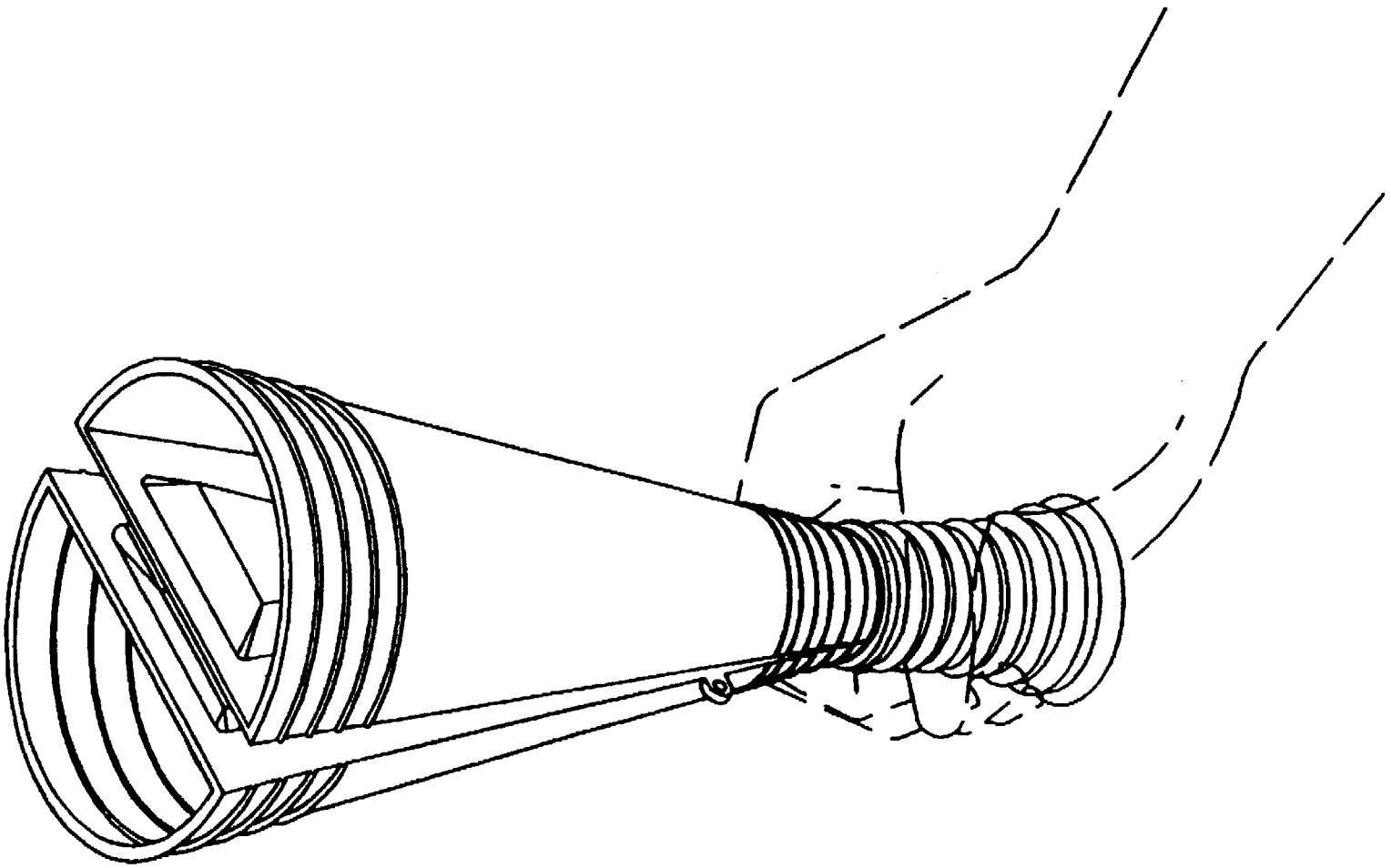
FIG. 6 illustrates the manner in which the present invention is held for patting or striking it to produce loud sound.

Please further refer to FIG. 6. The user may also hold the present invention by the mouth piece 3 and slightly pat it with another hand or against the user's lap or other suitable area. At this point, the slightly open apart front portions of the two halves 1, 2 shall, due to their longer length than that of the rear portions from the protuberances 15, 25 to the rear ends thereof, springily pat or strike against each other, and the recesses 11, 21 provided in these front portions and serving as sound producers shall help the present invention to produce loud, clear and encouraging sound. The present invention can be quickly changed in its use as a horn or a sounder while it can be easily assembled and effortlessly operated.

What is claimed is:

1. A horn and a sounder used for cheering during a game to produce loud and encouraging sound, comprising an upper body, a lower body, and a mouth piece; said upper and said lower bodies having a semicircular cross section and together forming two symmetrical halves of a horn, said two bodies each being provided on an outer periphery near a front end and a rear end with anti-slip lines and on an inner plane at a front portion with a recess serving as a sound producer, and, on said inner plane at a rear portion with a protuberance, said upper and said lower bodies further having a plurality of first annular ribs formed on a rear outer periphery, and said mouth piece having a plurality of second annular ribs formed on an outer surface thereof and thereby forming a plurality of corresponding annular grooves on an inner wall of said mouth piece, whereby said mouth piece is put over said upper and said lower bodies to bind them together by engaging said annular grooves of said mouth piece with said first annular ribs of said upper and said lower bodies, with said front portions of said upper and said lower bodies slightly open apart due to said protuberances which press against each other when said two bodies are bound together by said mouth piece.

* * * * *